US007757613B2

(12) United States Patent
Fisher

(10) Patent No.: US 7,757,613 B2
(45) **Date of Patent: *Jul. 20, 2010**

(54) ADJUSTABLE PORTABLE TABLE APPARATUS

(76) Inventor: Scott E. Fisher, 7860 E. Camino Los Brazos, Tucson, AZ (US) 85750

( * ) Notice: Subject to any disclaimer, the term of this patent is extended or adjusted under 35 U.S.C. 154(b) by 1053 days.

This patent is subject to a terminal disclaimer.

(21) Appl. No.: 11/046,612

(22) Filed: Jan. 27, 2005

(65) Prior Publication Data

US 2006/0162621 A1 Jul. 27, 2006

(51) Int. Cl.
*A47B 23/00* (2006.01)

(52) U.S. Cl. ..... 108/44

(58) Field of Classification Search ..... 108/44, 108/43, 150, 50.12; 224/521, 519, 518, 404, 224/524, 527, 314; 135/16; 296/26.09, 26.08
See application file for complete search history.

(56) References Cited

U.S. PATENT DOCUMENTS 5,181,822 A 1/1993 Allsop et al.
5,397,147 A 3/1995 Ducharme et al.
5,857,741 A * 1/1999 Anderson ..... 108/44
5,881,937 A 3/1999 Sadler
5,950,617 A * 9/1999 Lorenz ..... 108/44
6,082,269 A * 7/2000 Padberg ..... 108/44
6,189,458 B1 * 2/2001 Rivera ..... 108/44
6,314,891 B1 * 11/2001 Larson ..... 108/44
6,336,413 B1 1/2002 Ball
6,662,983 B2 * 12/2003 Lane et al. ..... 108/44
6,739,269 B1 * 5/2004 Benton ..... 108/44
6,752,088 B2 * 6/2004 Poarch et al. ..... 108/44

OTHER PUBLICATIONS

Travel Mate, Quadratic, Summer 1999, p. 22.

* cited by examiner

*Primary Examiner*—José V Chen
(74) *Attorney, Agent, or Firm*—Dale F. Regelman; Quarles & Brady LLP

(57) ABSTRACT

A portable table apparatus is disclosed, where that apparatus can be releaseably attached to a vehicle. The apparatus comprises a horizontal assembly, a vertical assembly, and a table.

18 Claims, 15 Drawing Sheets

ADJUSTABLE PORTABLE TABLE APPARATUS

FIELD OF THE INVENTION

The invention is directed to an adjustable portable table apparatus. In certain embodiments, Applicant's adjustable portable table apparatus further includes an adjustable-height umbrella assembly.

BACKGROUND OF THE INVENTION

The prior art teaches use of tables that can attach to the back of a vehicle using a trailer hitch assembly. Applications for such a table apparatus includes recreational uses and commercial uses. Such recreational uses include, example, hunting trips, camping trips, tailgate parties, and the like. Commercial uses include, for example, construction sites, utility installation sites, and the like.

Prior art devices, however, are generally suited for use with one vehicle, or one type of vehicle, and then only for either recreational use or commercial use. What is needed is a portable table assembly wherein certain dimensions of that apparatus can be adjusted, such that the portable table assembly can be used with a variety of vehicles, both recreationally and commercially.

SUMMARY OF THE INVENTION

Applicant's invention includes an adjustable portable table apparatus, optionally including an adjustable height umbrella, which can be releaseably attached to a vehicle. Applicant's apparatus comprises a horizontal assembly comprising a first end, a second end, and a first length, where that first length can be adjusted, and where the first end is capable of being releaseably attached to the vehicle. Applicant's apparatus further comprises a table in combination with a vertical assembly comprising a first end and a second end, where the first end of the vertical assembly is attached to the second end of the horizontal assembly, and the second end of the vertical assembly is attached to the table bottom.

Applicant's apparatus optionally further comprises an adjustable height shelter assembly comprising an umbrella in combination with an umbrella shaft. In these embodiments, Applicant's table comprising a center point formed to include an aperture extending through that center point, where the umbrella shaft extends through the aperture and through the tubular vertical assembly. The position of the umbrella shaft within the vertical assembly, and thus the height of the umbrella, can be adjusted upwardly and downwardly.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

Figure 1:
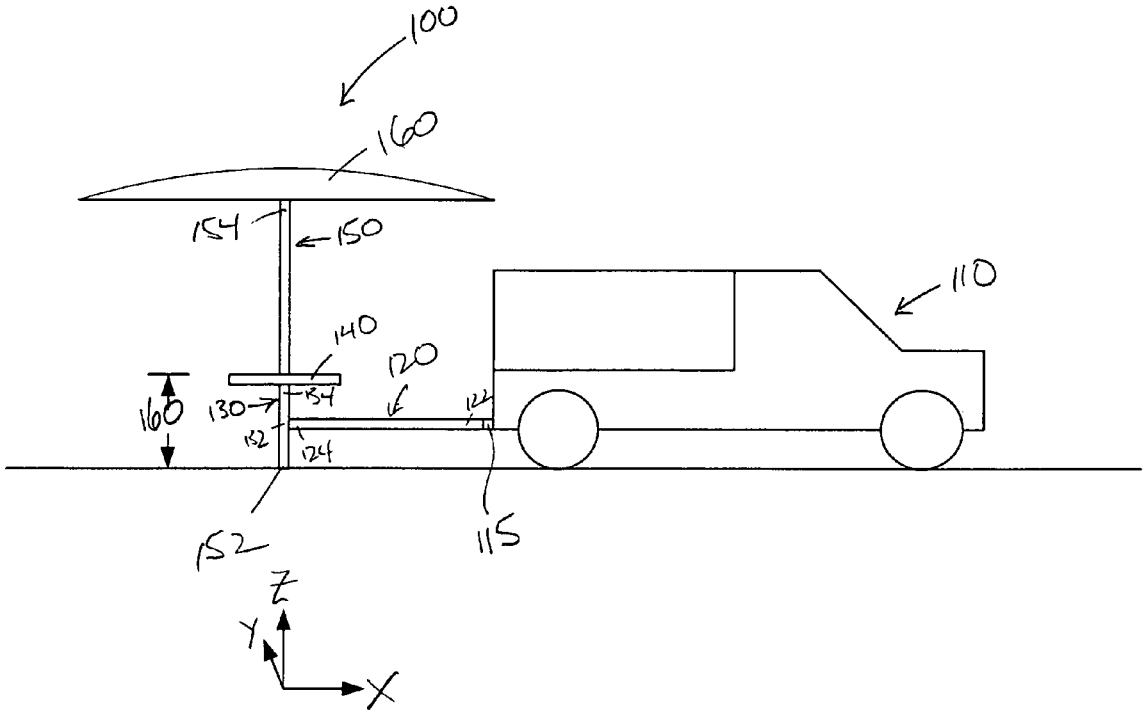
FIG. 1 is a side view of a vehicle releaseably connected to Applicant's portable apparatus which comprises a horizontal assembly, a vertical assembly, a table, and a shelter assembly.

This invention is described in preferred embodiments in the following description with reference to the Figures, in which like numbers represent the same or similar elements. Referring now to FIG. 1, Applicants' invention comprises an apparatus which can be removeably attached to a vehicle, such as vehicle 110, comprising a trailer hitch receiving assembly 115. In the illustrated embodiment of FIG. 1, trailer hitch receiving assembly 115 is disposed on the rear portion of vehicle 110. In other embodiments of Applicant's invention, the trailer hitch receiving assembly 115 may be disposed on the front portion, and/or on a side portion of the vehicle.

Figure 12A:
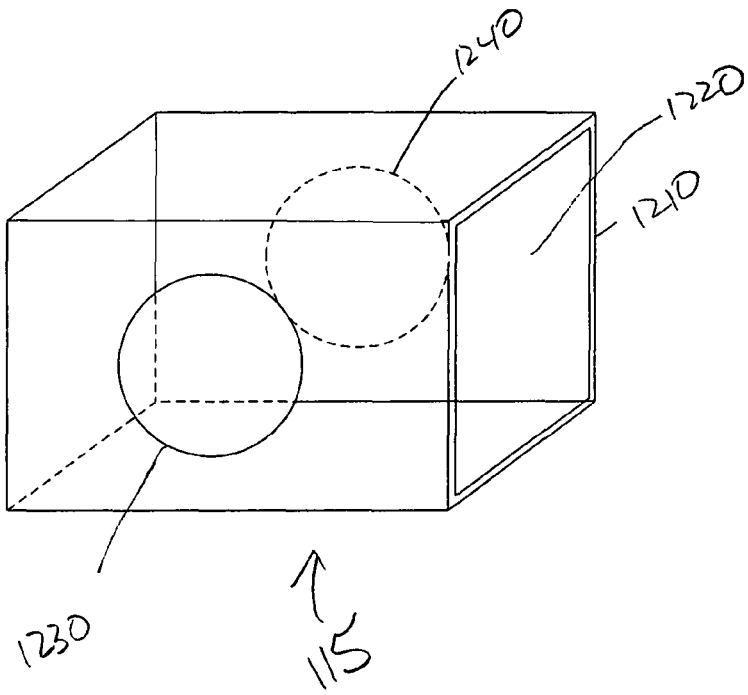
FIG. 12A is a perspective view of a trailer hitch receiving assembly.

Applicant's apparatus comprises assembly 120 which comprises end 122 which can be releaseably engaged with trailer hitch receiving assembly 115 and end 124 which can be releaseably attached to end 132 of assembly 130. FIG. 12A shows a perspective view of trailer hitch receiving assembly 115.

Referring now to FIG. 12A, trailer hitch receiving assembly 115 comprises enclosure 1210 formed to include open end 1220. Assembly 115 is further formed to include aperture 1230 in a first side wall and aperture 1240 in a second, opposing side wall. A trailer hitch which is formed to include a pair of opposing apertures can be inserted into assembly 115, and a crossbolt is then inserted through both apertures in assembly 115 and also through both apertures in the trailer hitch thereby releaseably coupling the trailer hitch to the trailer hitch receiving assembly.

Figure 12B:
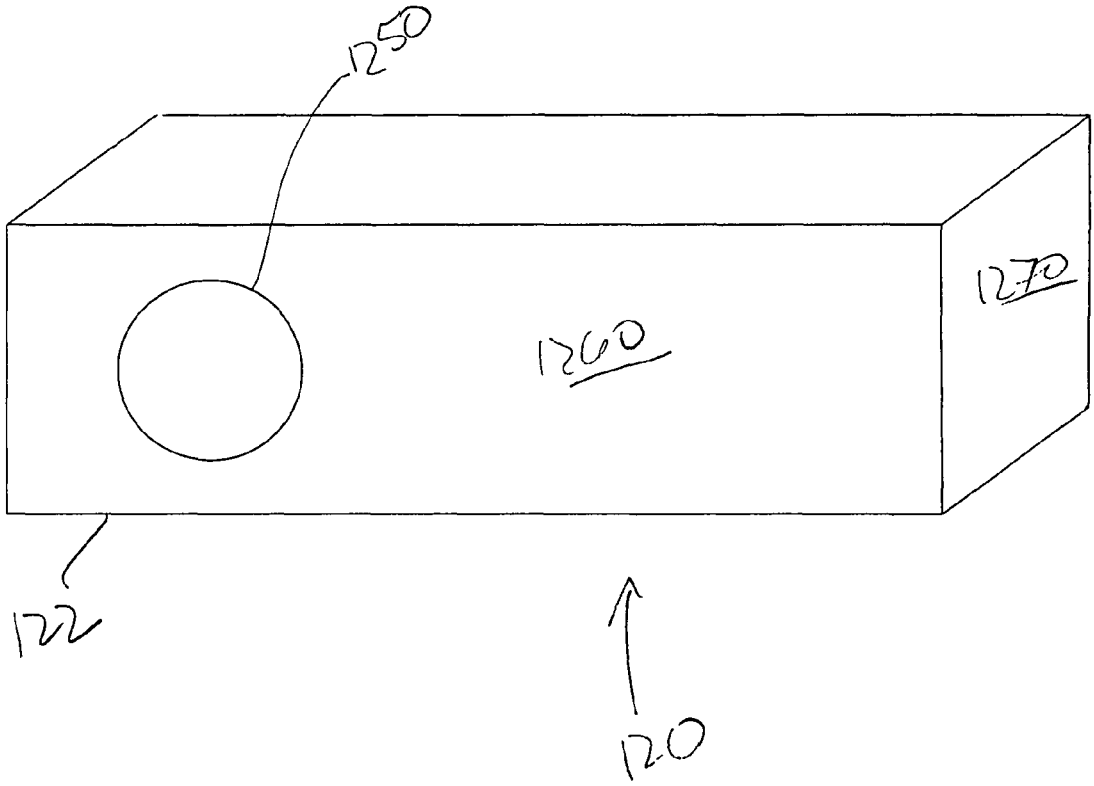
FIG. 12B is a perspective view of a first end of one embodiment of Applicant's horizontal assembly.

Referring now to FIG. 12B, in certain embodiments end 122 of horizontal assembly 120 is formed to include aperture 1250 in wall 1260. In certain embodiments, end 122 of horizontal assembly 120 is formed to include only one aperture, namely aperture 1250 in wall 1260, wherein end 122 is not formed to include a second, opposing aperture in wall 1270. End 122 of horizontal assembly 120 can be inserted into open end 1220 of trailer hitch receiving assembly 115 such that aperture 1250 is aligned with aperture 1230.

Figure 13A:
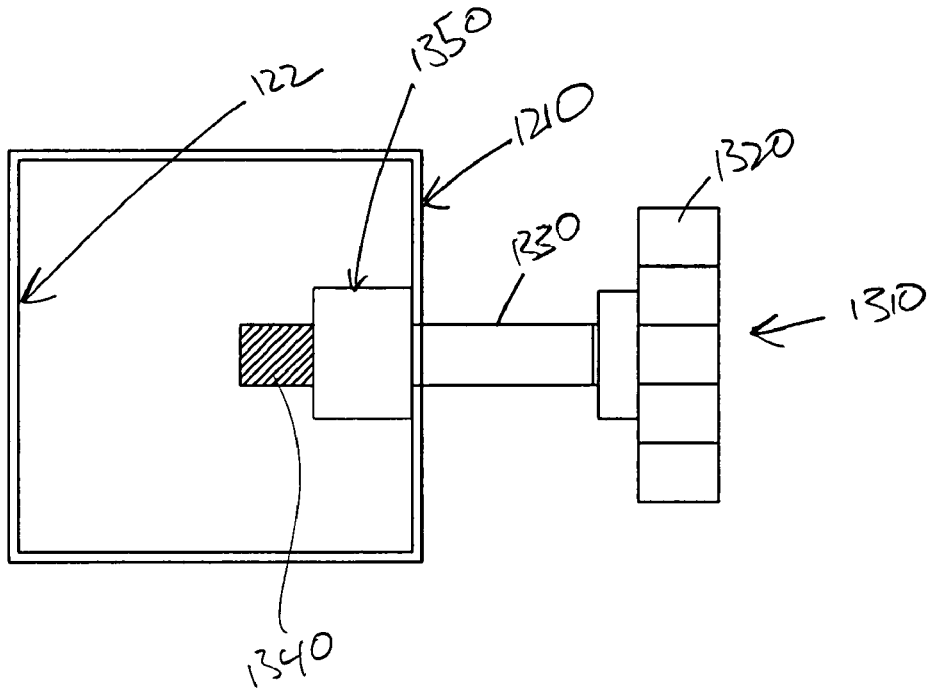
FIG. 13A is a cross sectional view of the first end of FIG. 12B inserted into the trailer hitch receiving assembly of FIG. 12A.
Figure 13B:
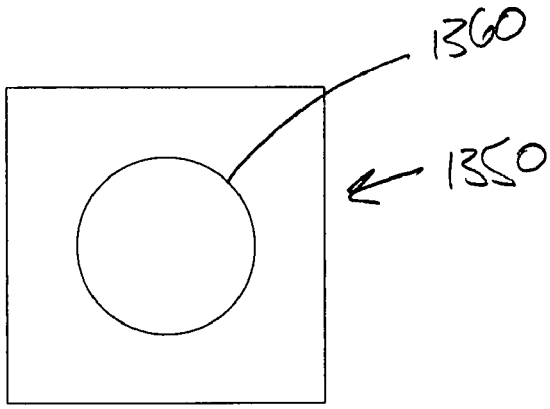
FIG. 13B is a top view of a nut disposed within the first end of FIG. 12B.

Referring now to FIGS. 13A and 13B, in certain embodiments end 122 of horizontal assembly 120 further includes nut 1350 disposed on the interior portion of end 122, wherein nut 1350 is formed to include threaded aperture 1360. Securing means 1310 comprises handle portion 1320 and shaft 1330 which is attached to handle 1320 and extends outwardly therefrom. Distal end 1340 of shaft 1330 is threaded, such that end 1340 can be threadedly engaged with threaded aperture 1360.

In the embodiments of FIGS. 12B, 13A, and 13B, end 122 of horizontal assembly 120 is inserted into trailer hitch receiving assembly 115 such that apertures 1250, 1230, and 1360, are aligned. End 1340 of shaft 1330 is then inserted through aperture 1230 in receiving assembly 115, through aperture 1250 in end 122, to threadedly engage threaded aperture 1360. Rotating handle 1320 releaseably attaches end 122 to assembly 115. Moreover, handle 1320 can be rotated until the releasable attachment of end 122 to assembly 115 has been "snugged tight" such that end 122 cannot wobble at all within assembly 115.

This means of releaseably attaching horizontal assembly 120 to a vehicle provides a secure attachment that permits no movement of horizontal assembly 120. Such a releaseably attachment provides stability to table 140 which is not available if end 122 included a pair of opposing apertures, and a crossbolt was inserted through the opposing apertures in end 122 and in assembly 115.

Referring once again to FIG. 1, table 140 is releaseably attached to end 134 of vertical assembly 130. In certain embodiments, vertical assembly 130 comprises a tubular member having a diameter, a first open end, and a second open end.

In certain embodiments, table 140 is releaseably attached to end 134 of assembly 130. In certain embodiments, table 140 is formed to include an aperture having said diameter and extending therethrough, wherein that aperture is located at the approximate center of the table in the X/Y plane.

In the illustrated embodiment of FIG. 1, apparatus 100 further comprises a protective shelter comprising umbrella 160 and umbrella shaft 150. Further in the illustrated embodiment of FIG. 1, umbrella shaft 150 extends through assembly 130 and table 140. In the illustrated embodiment of FIG. 1, end 152 of shaft 150 contacts the ground. End 154 of shaft 150 is attached to umbrella assembly 160. In certain embodiments, shaft 150 in combination with umbrella assembly 160 is sold in commerce as a "patio umbrella."

Table 140 comprises a variety of shapes and dimensions. In certain embodiments, table 140 has a thickness of about 0.5 inch. In other embodiments, table 140 has a thickness of about 0.75 inch. In still other embodiments, table 140 has a thickness of about one inch. In yet other embodiments, table 140 has a thickness greater than one inch.

In certain embodiments, table 140 has a top surface area of about 1000 square inches. In other embodiments, table 140 has a top surface area of less than about 1000 square inches. In still other embodiments, table 140 has a top surface area of greater than about 1000 square inches.

In certain embodiments, table 140 has a square shape in the X/Y plane. In certain embodiments, table 140 has a rectangular shape in the X/Y plane. In other embodiments, table 140 has a round shape in the X/Y plane. In yet other embodiments, table 140 has a hexagonal shape in the X/Y plane. In still other embodiments, table 140 has an octagonal shape in the X/Y plane.

In certain embodiments, vertical assembly 130 is about 12 inches in length. As a general matter, horizontal assembly 120 is disposed at a height of about 17 inches above the ground. Using a vertical assembly having a length of 12 inches in combination with a one inch thick table positions the top of that table 140 about 30 inches above the ground. A typical dining table has a height above the ground of about thirty (30) inches.

A vertical assembly about 12 inches in length facilitates recreational use of Applicant's portable table apparatus. As those skilled in the art will appreciate, depending on the actual height of horizontal assembly 120 when attached to a vehicle, the length of vertical assembly 130 can be adjusted such that the top of table 140 is about 30 inches above the ground.

In certain embodiments, vertical assembly 130 is about 18 inches in length. As a general matter, horizontal assembly 120 is disposed at a height of about 17 inches above the ground. Using a vertical assembly having a length of 18 inches in combination with a one inch thick table positions the top of that table 140 about 36 inches above the ground. A typical counter/work bench height has a height above the ground of about thirty-six (36) inches. A vertical assembly about 18 inches in length facilitates commercial use of Applicant's portable table apparatus. As those skilled in the art will appreciate, depending on the actual height of horizontal assembly 120 when attached to a vehicle, the length of vertical assembly 130 can be adjusted such that the top of table 140 is about 36 inches above the ground.

As those skilled in the art will appreciate, the industry standard for bar counter height is 42 inches to 48 inches. Depending on the actual height of horizontal assembly 120 when attached to a vehicle, the length of vertical assembly 130 can be adjusted such that the top of table 140 is between about 42 inches and about 48 inches above the ground. In these bar counter height embodiments, conventional bar stools and/or folding director's chairs can be comfortably used in combination with Applicants' adjustable table apparatus Referring now to FIG. 2A, in certain embodiments assembly 120 comprises tubular member 210, member 220, and fixturing means 230. Tubular member 210 is formed to include an enclosure space 212 dimensioned such that all or a portion of member 220 can be slidingly disposed within space 212. The orientation of table 140 can be adjusted in a first plane orthogonal to the horizontal member, i.e. the Y/Z plane, by rotating member 220 and then fixturing member 220 to tubular member 210.

Figure 2A:
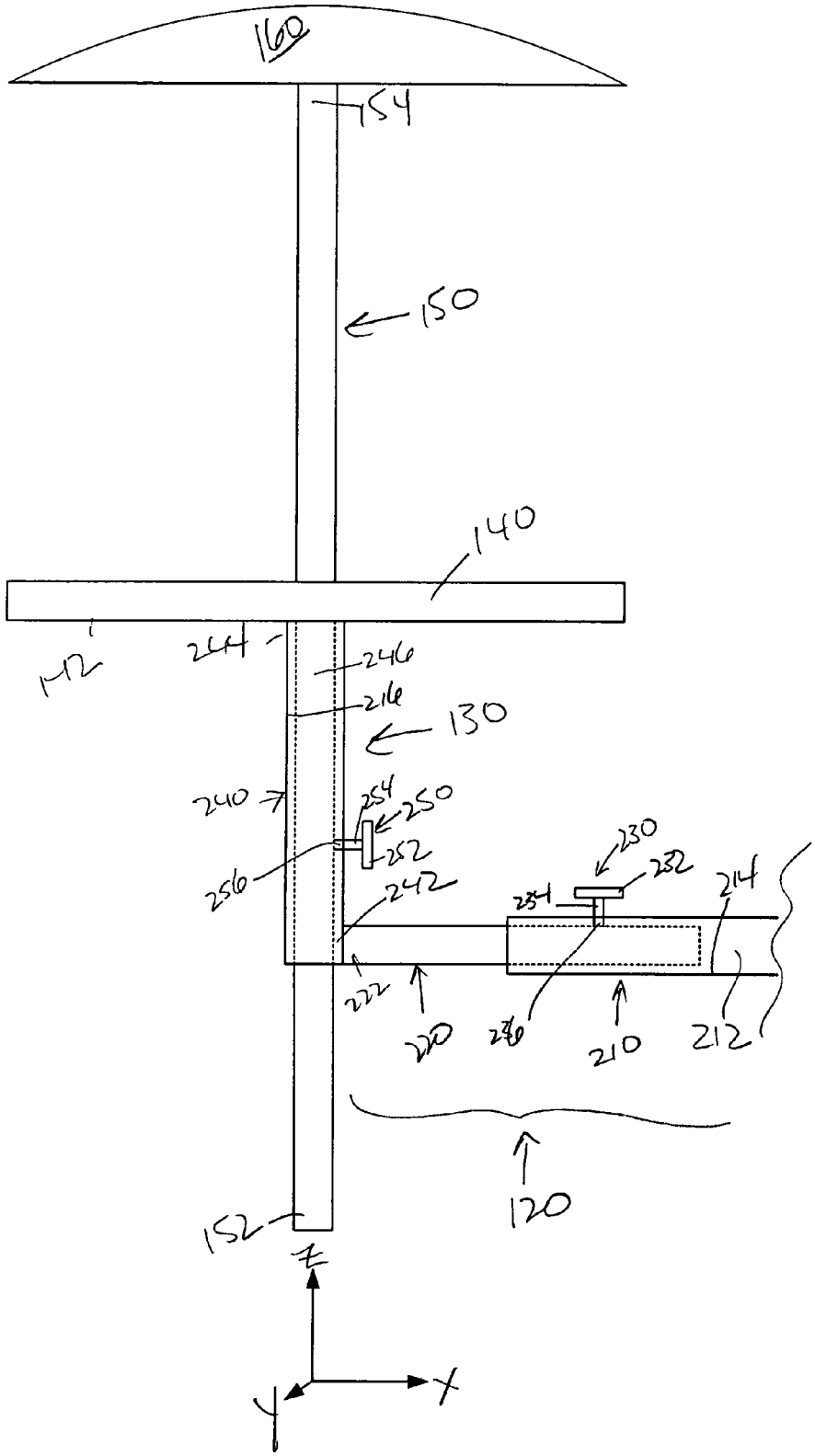
FIG. 2A is a side view showing one embodiment of Applicant's horizontal assembly.

In the illustrated embodiment of FIG. 2A, fixturing means 230 comprises a T-shaped apparatus comprising a handle 232 and a threaded shaft 234. In these embodiments, tubular member 210 is formed to include a threaded aperture into which threaded shaft 234 can be threadedly engaged.

In order to fixture member 220 within tubular member 210, handle 232 is rotated in a first direction such that shaft 234 is moved inwardly into space 212 until the distal end of shaft 234 contacts tubular member 220 and forces member 220 against the interior 214 of tubular member 210 thereby fixturing member 220 in place. In order to release tubular member 220 from tubular member 210, handle 232 is rotated in a second direction such that shaft 234 is moved outwardly such that the distal end of shaft 234 no longer forces member 220 against the interior 214 of tubular member 210 thereby releasing member 220.

In certain embodiments, the interior surface 214 of tubular member comprises a round cross-section. In these embodiments, member 220 also comprises a round cross-section. In other embodiments, the interior surface 214 of tubular member comprises a square cross-section. In these embodiments, member 220 also comprises a square cross-section. In yet other embodiments, the interior surface 214 of tubular member comprises a hexagonal cross-section. In these embodiments, member 220 also comprises a hexagonal cross-section. In still other embodiments, the interior surface 214 of tubular member comprises an octagonal cross-section. In these embodiments, member 220 also comprises an octagonal cross-section.

Figure 10:
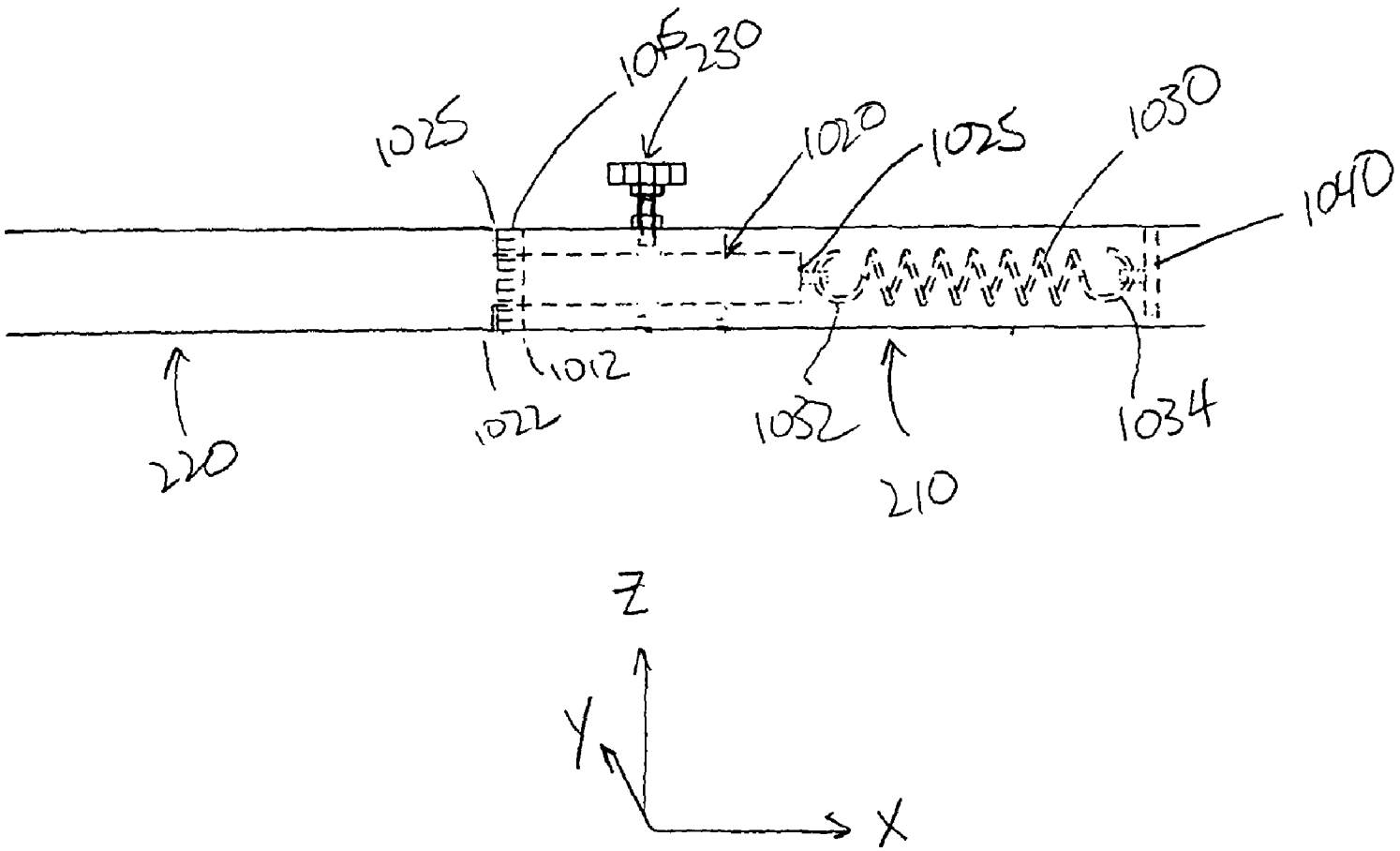
FIG. 10 is a side view showing an alternative embodiment for Applicant's horizontal assembly.

Referring now to FIG. 10, in certain embodiments member 220 comprises a first set of gear teeth 1025 disposed on end 1022. In these embodiments, member 210 comprises a second set of gear teeth 1015 disposed on end 1012. Member 1020 is attached to end 1022 of member 220 and extends outwardly therefrom. Member 1020 is dimensioned such that member 1020 can be inserted into tubular member 210. Gear teeth 1025 can be mated with gear teeth 1015 such that member 1020 cannot rotate within tubular member 210.

Spring 1030 is disposed within tubular member 210 and comprises first end 1032 and second end 1034. First end 1032 is attached to distal end 1025 of member 1020. Second end 1034 is attached to member 1040 which is disposed within tubular member 210. Spring 1030 is disposed within tubular member 210 such that spring 1030 pulls member 220 in the +X direction to keep gear teeth 1025 mated with gear teeth 1015.

In the embodiment of FIG. 10, the orientation of member 220 with respect to member 210 can be adjusted by manually pulling member 220 a sufficient distance in the −X direction to disengage gear teeth 1025 from gear teeth 1015. Member 220 can then to rotated in the Y/Z plane to a desired orientation. Thereafter, member 220 is released allowing spring 1030 to pull gear teeth 1025 into a mated relationship with gear teeth 1015 thereby locking member 220 into the desired orientation.

Referring again to FIG. 2A, assembly 130 comprises tubular member 240 and fixturing means 250. Tubular member 240 is formed to enclose space 246. In the illustrated embodiment of FIG. 2A, umbrella shaft 150 extends through table 140, and through tubular member 240, such that distal end 152 contacts the ground. Proximal end 154 of shaft 150 is attached to umbrella portion 160.

In the illustrated embodiment of FIG. 2A, fixturing means 250 comprises a T-shaped apparatus comprising a handle 252 and a threaded shaft 254. In these embodiments, tubular member 240 is formed to include a threaded aperture into which threaded shaft 254 can be threadedly engaged.

In order to releaseably fixture umbrella shaft 150 within tubular member 240, handle 252 is rotated in a first direction such that shaft 254 is moved inwardly into space 246 until the distal end of shaft 254 contacts shaft 150 and forces shaft 150 against the interior 246 of tubular member 240 thereby fixturing umbrella shaft 150 in place. In order to release umbrella shaft 150 from tubular member 240, handle 252 is rotated in a second direction such that shaft 254 is moved outwardly such that the distal end of shaft 254 no longer forces umbrella shaft 150 against the interior 246 of tubular member 240 thereby releasing umbrella shaft 150.

Figure 2B:
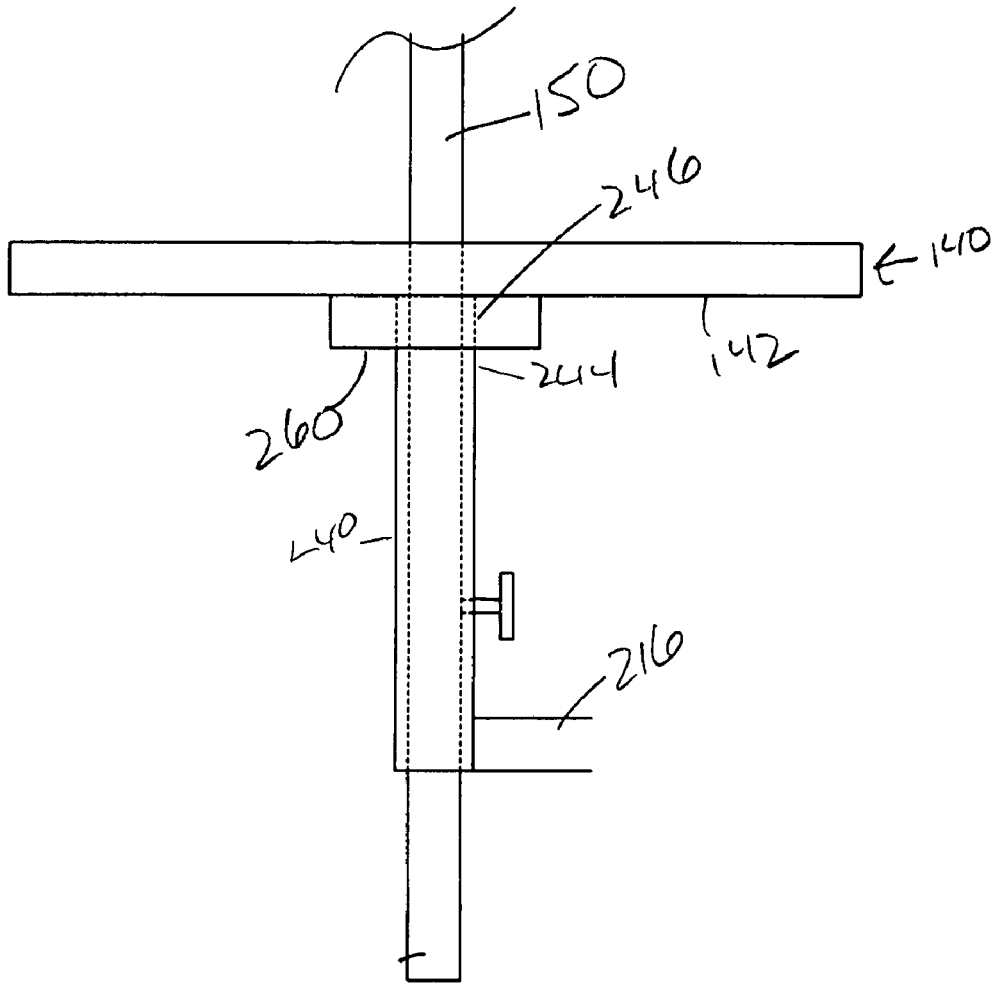
FIG. 2B shows one embodiment of the attachment of Applicant's table element to vertical assembly.

End 244 of tubular member 240 is attached to the bottom 142 of table 140. In certain embodiments, end 244 is releaseably attached to bottom 142. Referring now to FIG. 2B, in certain embodiments attachment plate 260 formed to include a threaded aperture is permanently affixed to bottom 142, wherein end 244 of tubular member 240 comprises threaded portion 246, wherein threaded portion 246 can engage the threaded aperture of attachment plate 260. In these embodiments, table 140 and tubular member 240 can be separated for transportation and/or storage.

Figure 3A:
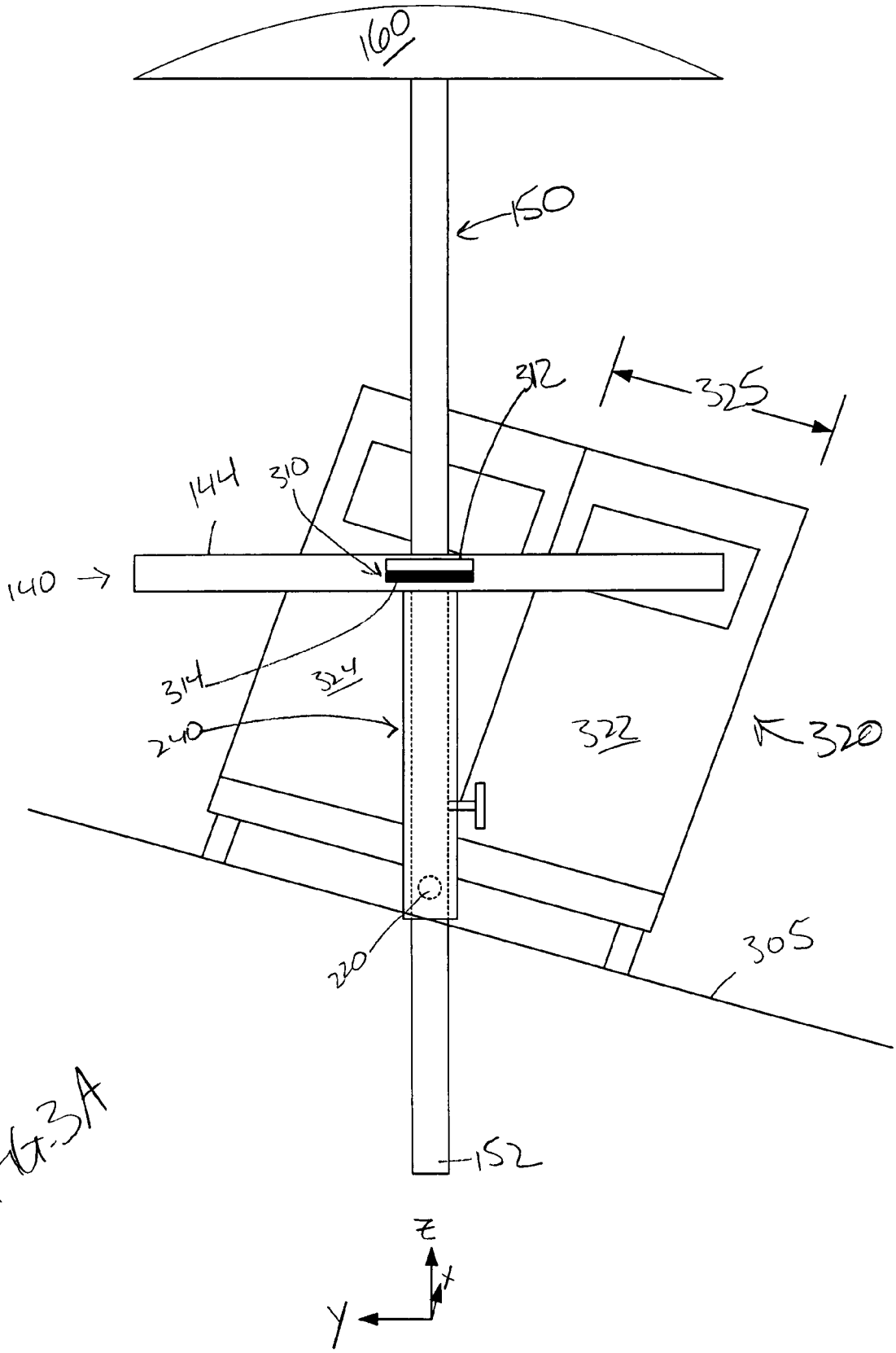
FIG. 3A shows a perspective view of the vehicle and apparatus of FIG. 1, wherein the vertical axis of Applicant's apparatus is offset from the vertical axis of the vehicle.

Referring now to FIGS. 2A and 3A, member 220 can be rotated in Y/Z plane to adjust the orientation of table 140 and umbrella 160 with respect to vehicle 320. In the illustrated embodiment of FIG. 3A, vehicle 320 is parked on an incline 305. Nevertheless, table 140 comprises a gravitationally level orientation, such that objects placed on top surface 144 of table 140 will not slide/roll off the table. In certain embodiments, table 140 further comprises leveling device 310 to assist in rotating member 220 within tubular member 210 such that table 140 comprises a gravitationally level orientation. As those skilled in the art will appreciate, leveling device 310 comprises an optically clear enclosure 312 which is partially filled with fluid 314, where the orientation of fluid 314 within enclosure 312 visually indicates the gravitational orientation of table 140.

Figure 3B:
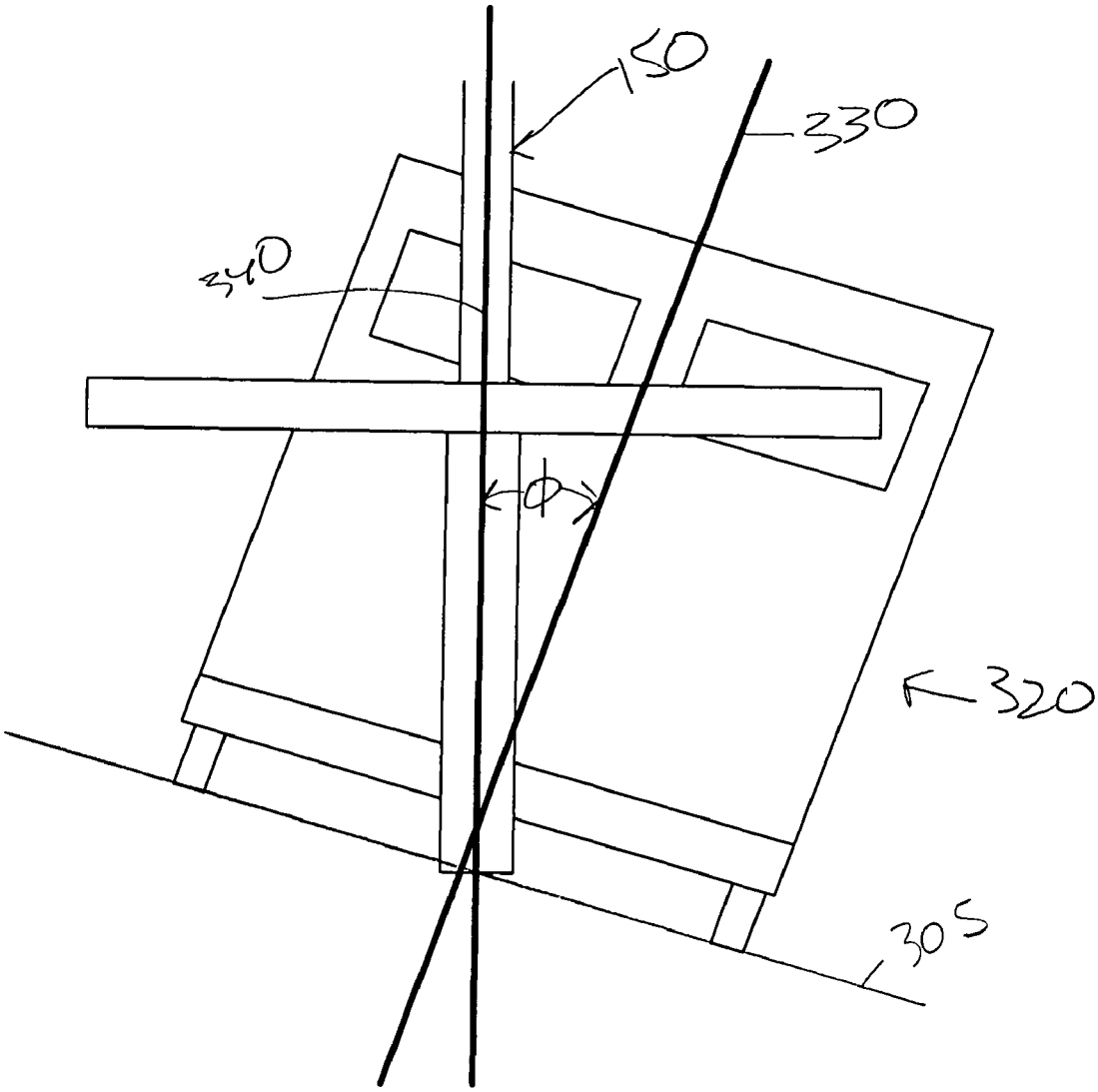
FIG. 3B graphically shows the vertical axis of Applicant's apparatus and the vertical axis of the vehicle.

Referring now to FIG. 3B, vehicle 320 has vertical axis 330, where that vertical axis 330 is perpendicular to ground surface 305. Umbrella shaft 150 has vertical axis 340. In the illustrated embodiments of FIGS. 2A and 2B, the umbrella shaft vertical axis 340 is offset from vehicle vertical axis 330 by angle Φ. In embodiments wherein interior surface 214 of tubular member 210 is round, and wherein member 220 comprises a round cross-section, angle Φ is continuously adjustable. In embodiments, wherein interior surface 214 of tubular member 210 comprises a hexagonal cross-section, and wherein member 220 comprises a hexagonal cross-section, angle Φ is adjustable in 60 degree increments. As a general matter, where interior surface 214 of tubular member 210 is formed to comprise (N) sides, i.e. interior surface 214 comprises an (N)thagonal cross-section, and where member 220 also comprises that same (N)thagonal cross-section, then angle Φ is adjustable in 360/(N) degree increments.

Figure 4A:
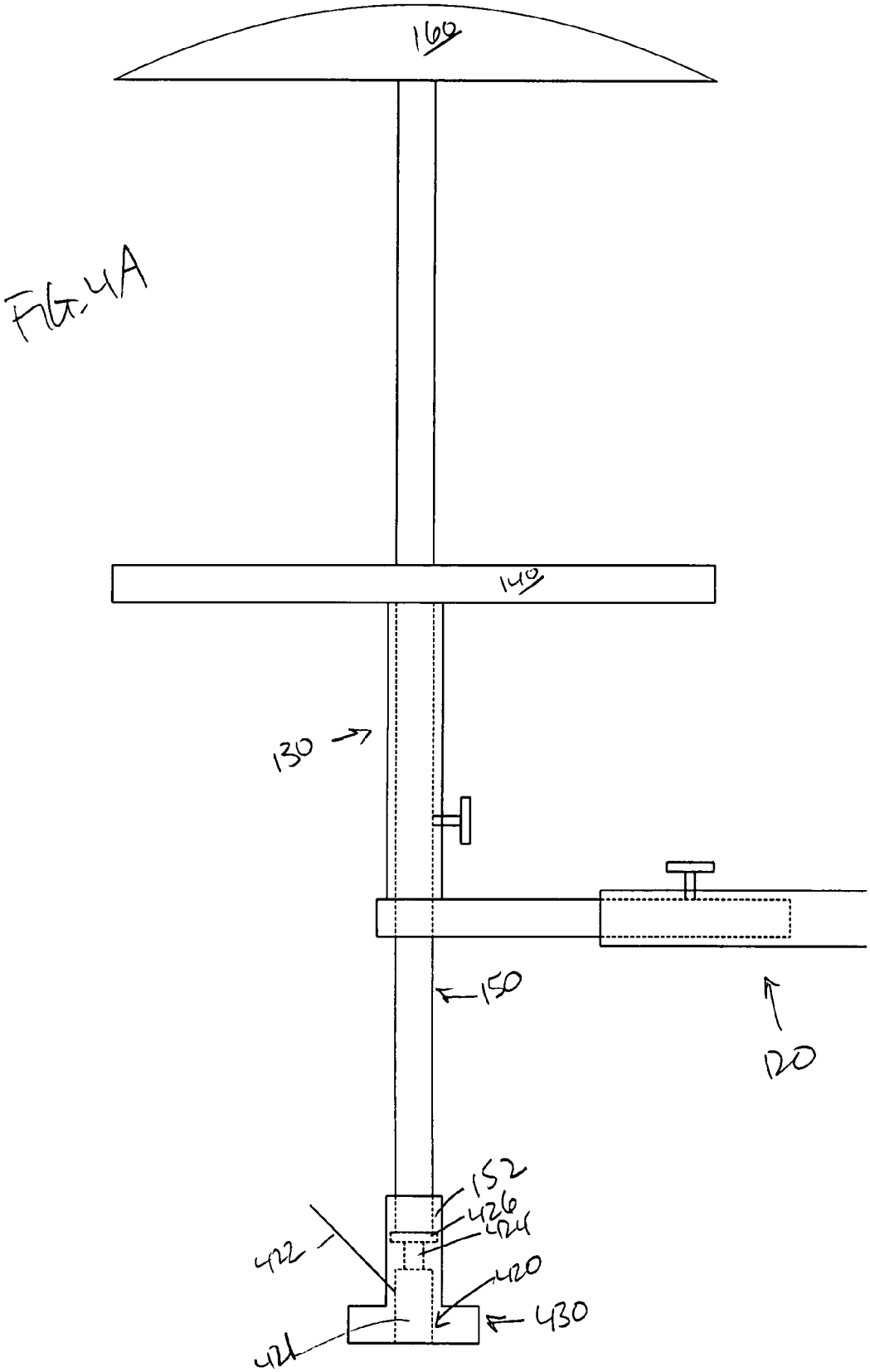
FIG. 4A is a side view of a one embodiment of Applicant's lifting apparatus disposed in the apparatus of claim 1.

In certain embodiments, Applicant's apparatus includes a lifting mechanism to adjust the height of umbrella portion 160. For example, the illustrated embodiment of FIG. 4A includes base assembly 430. Assembly 430 comprises hydraulic lifting mechanism 420. Lifting mechanism 420 comprises handle 422, hydraulic actuator 421, and moveable shaft 424. In certain embodiments, platen 426 is disposed on the distal end of shaft 424.

Moving handle upwardly and downwardly raises shaft 424 upwardly, thereby increasing the height above the ground of umbrella 160. After reversing the operational mechanism of lifting mechanism 420, moving handle upwardly and downwardly lowers shaft 424 upwardly, thereby decreasing the height above the ground of umbrella 160.

Figure 4B:
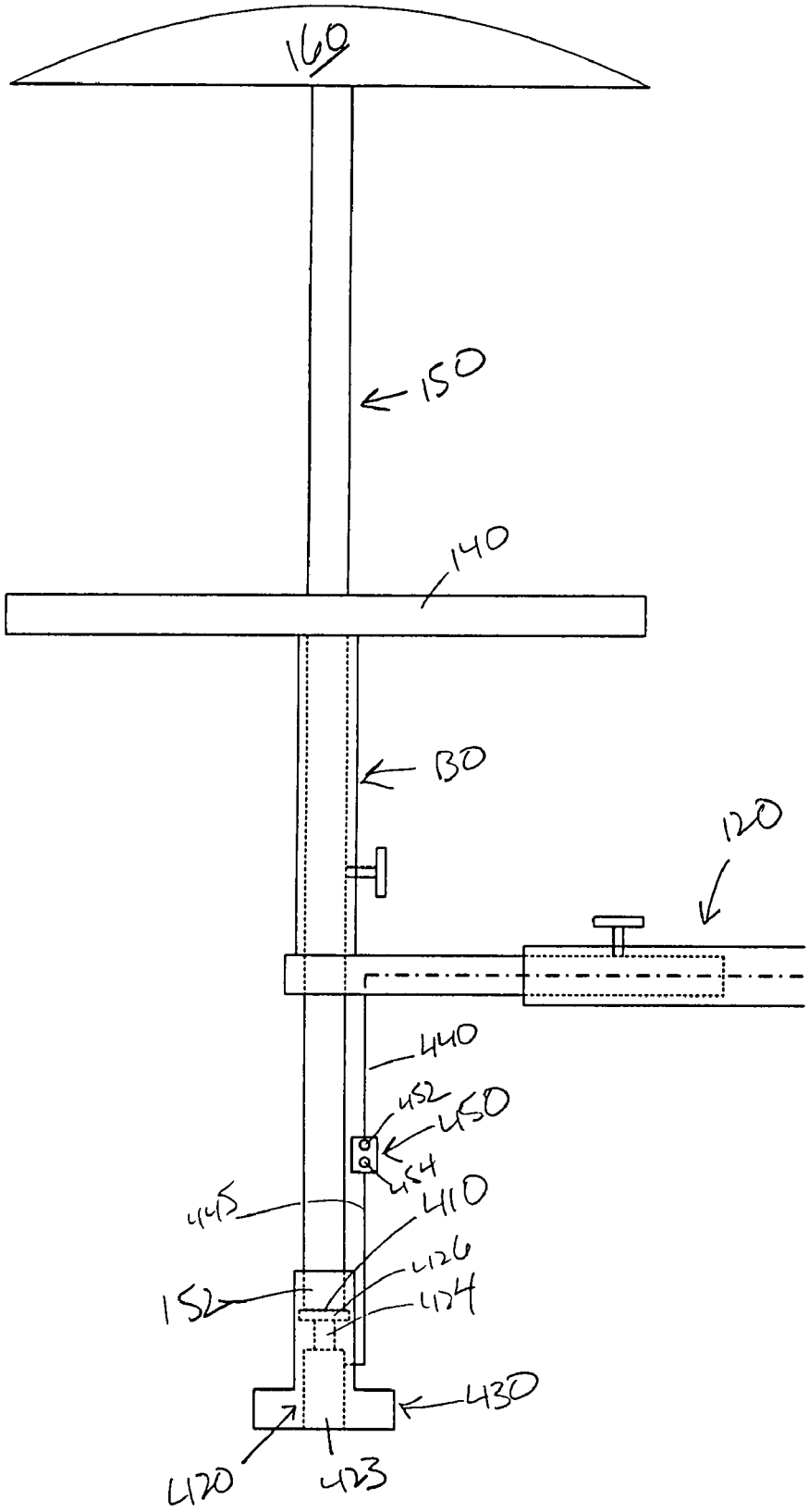
FIG. 4B a side view of a second embodiment of Applicant's lifting apparatus disposed in the apparatus of claim 2.

In certain embodiments, Applicant's apparatus further comprises an electrical lifting mechanism. Referring now to FIG. 4B, power cable 440 interconnects the 12 Volt electrical system disposed in a vehicle, such as for example vehicle 110 or vehicle 320, and switch 450. Power cable 445 interconnects switch 450 and motor 423. Switch 450 comprises first actuator 452 and second actuator 454. In the illustrated actuator 452 comprises a first push-button and actuator 454 comprises a second push-button. Depressing button 452 causes motor 423 to move shaft 424 in a first direction. In certain embodiments, that first direction is upwardly, i.e. in the +Z direction. Depressing button 454 causes motor 423 to move shaft 424 in a second direction. In certain embodiments, that second direction is downwardly, i.e. in the −Z direction.

End 152 of umbrella shaft 150 rests on top of shaft 424, or optionally on top of platen 426. Depressing button 452 causes motor 423 to move shaft 424 upwardly thereby elevating umbrella portion 160. Depressing button 454 causes motor 423 to move shaft 424 downwardly thereby lowering umbrella portion 160.

Figure 5:
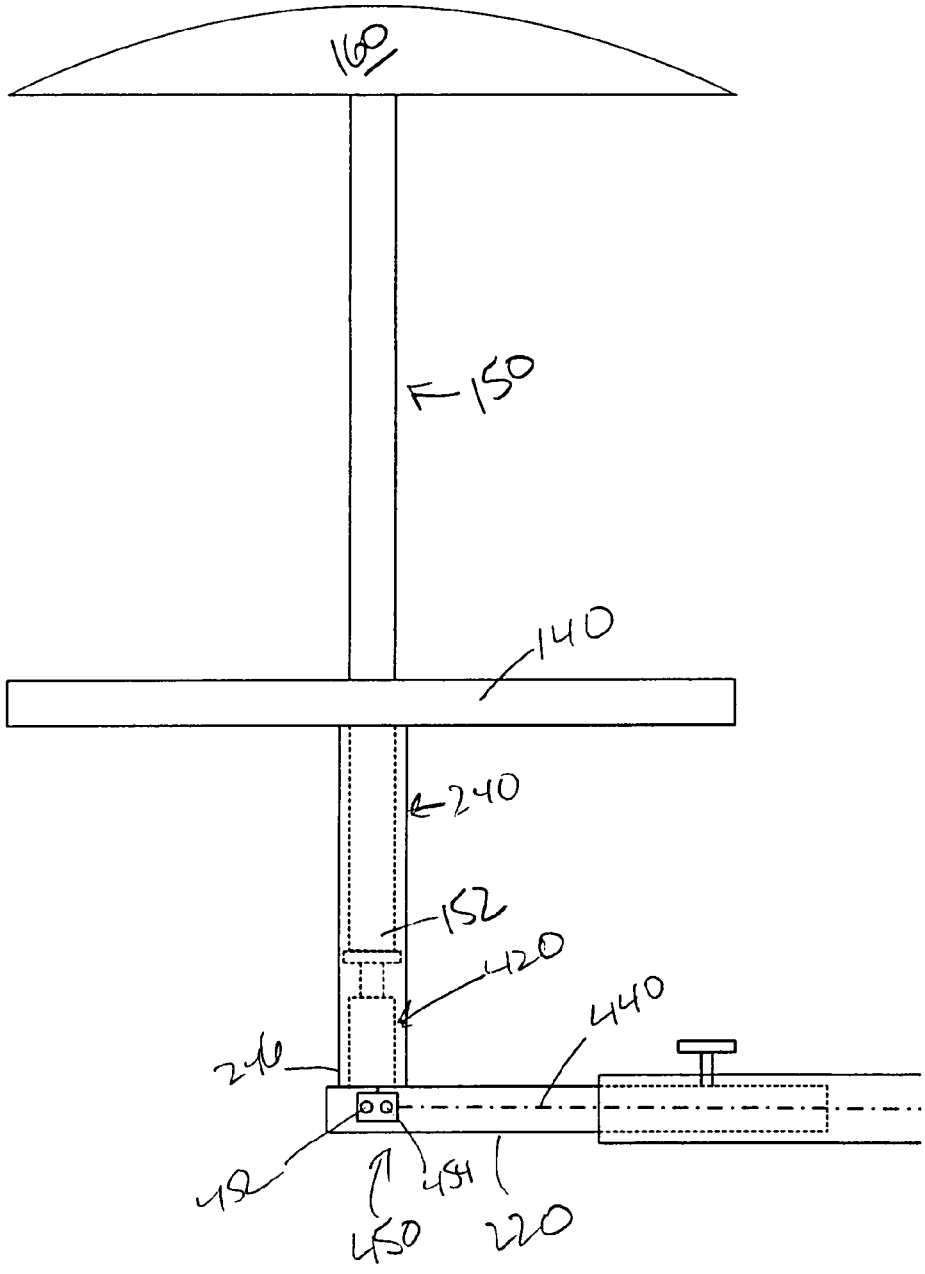
FIG. 5 is a side view of a second embodiment of Applicant's apparatus of claim 1, where that second embodiment includes the lifting apparatus of FIG. 4B.

In the illustrated embodiment of FIG. 5, lifting assembly 420 is disposed within end 246 of tubular member 240, and switch 450 is disposed on member 220. Depressing button 452 causes motor 422 to move shaft 424 upwardly thereby elevating umbrella portion 160. Depressing button 454 causes motor 422 to move shaft 424 downwardly thereby lowering umbrella portion 160.

In certain embodiments, Applicant's apparatus further comprises a plurality of lights disposed on umbrella 160, where those lights receive power from power cable 440. In yet other embodiments, Applicant's apparatus further comprises one or more power receptacles disposed on horizontal member 120, and/or table 140, wherein those one or more power receptacles receive power from power cable 440.

Figure 11:
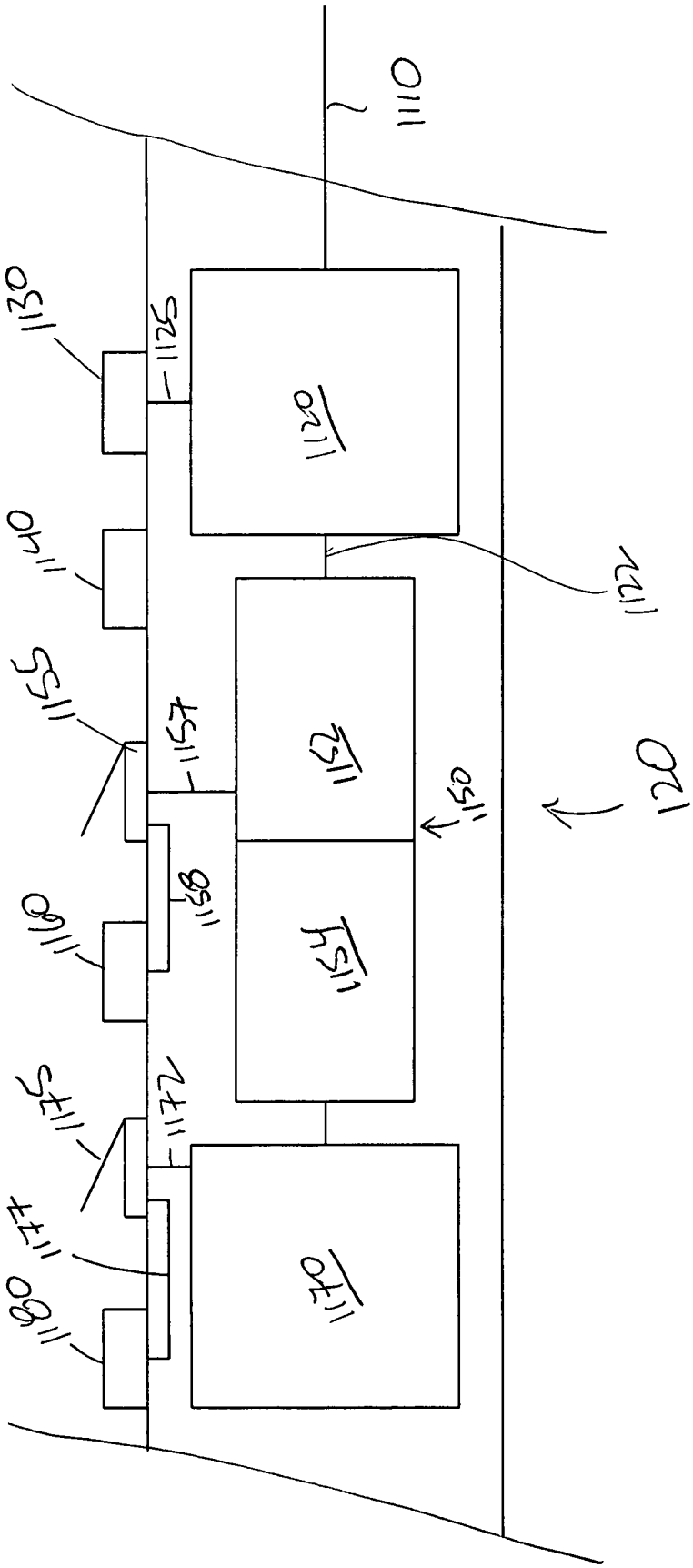
FIG. 11 is a block diagram showing certain electrical components disposed within and on Applicants' horizontal assembly.

Referring now to FIG. 11, in certain embodiments a plurality of rechargeable batteries 1150 are disposed within horizontal assembly 120. FIG. 11 shows two rechargeable batteries 1152 and 1154. In other embodiments, Applicant's apparatus comprises one rechargeable battery disposed within horizontal assembly 120. In still other embodiments, Applicant's apparatus comprises more than two rechargeable batteries disposed within horizontal assembly 120.

Plurality of rechargeable batteries 1150 receive charging power from charging unit 1120 via power conduit 1122. Charging unit 1120 is capable of receiving 115 volt, 60 hertz, AC input power and/or 12 volt DC input power. Charging unit 1120 receives DC input power from DC power conduit 1110 which interconnects with the vehicular power system disposed in the attached vehicle.

Charging unit 1120 receives AC input power from receptacle 1130 which is disposed on the exterior of horizontal assembly 120. As those skilled in the art will appreciate, receptacle 1130 can be interconnected using an extension cord with a source of nominal 115 volt/60 hertz utility power. Moreover, plurality of batteries 1150 can be recharged using charging unit 1120, receptacle 1130, and utility power, when Applicant's apparatus is disposed adjacent a source of utility power.

Indicator 1140 is disposed on the exterior of horizontal assembly 120. Indicator 1140 emits light in proportion to the amount of input power being consumed by charging unit 1120. In certain embodiments, indicator 1140 comprises one or more light emitting diodes and/or gauges.

Plurality of batteries 1150 are electrically interconnected to switch 1155 via DC power conduit 1157. Switch 1155 is electrically interconnected with DC output power receptacle 1160 via DC power conduit 1158. When switch 1155 is closed, plurality of batteries 1150 provide DC power to DC output power receptacle 1160.

Plurality of batteries 1150 are electrically interconnected to power inverter 1170 which is disposed within horizontal assembly 120. Inverter 1170 receives DC input power from batteries 1150 and provides 115 volt, 60 hertz, AC power to switch 1175 via AC power conduit 1172. Switch 1175 is electrically interconnected with AC switch 1175. Switch 1175 is electrically interconnected with AC output receptacle 1180 via power conduit 1177. When switch 1175 is closed, inverter 1170 draws DC power from plurality of batteries 1150, converts that DC power to AC power, and provides that AC power to AC output receptacle 1180 via switch 1175 and power conduits 1172 and 1177.

Figure 8:
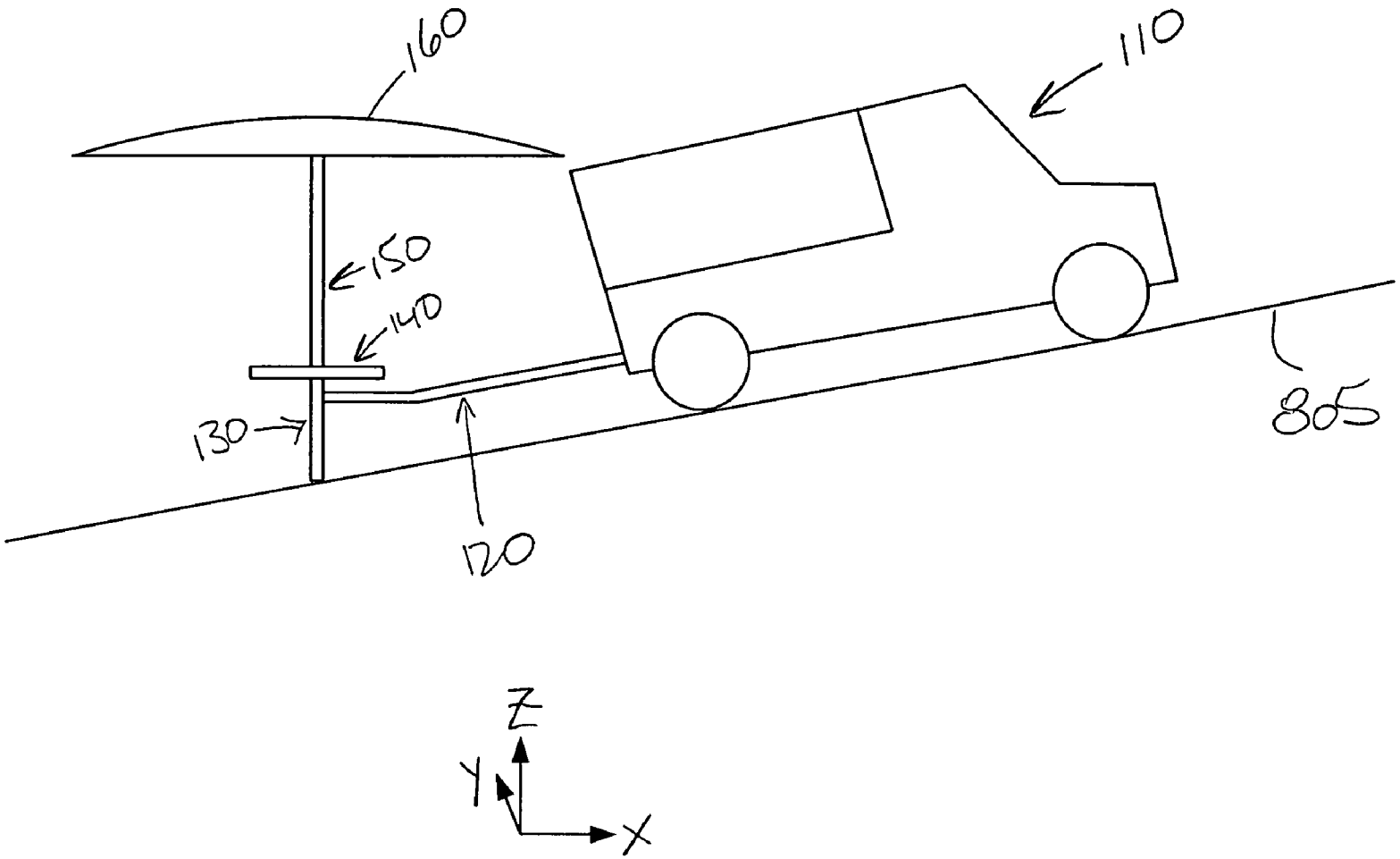
FIG. 8 shows a side view of another embodiment of Applicant's apparatus which comprises an adjustment means to keep the table portion of Applicant's apparatus level when the attached vehicle is disposed on an incline.

Referring now to FIG. 8, in certain embodiments Applicant's apparatus permits the adjustment of table 140 and umbrella 160 in a second plane, i.e. the X/Z plane, wherein the second plane is orthogonal to the first plane. FIG. 8 shows vehicle disposed on an incline 805. If horizontal assembly 120 could not be adjusted in the X/Z plane, then table 140 would not be level when vehicle 110 is parked on incline 805.

Figure 9:
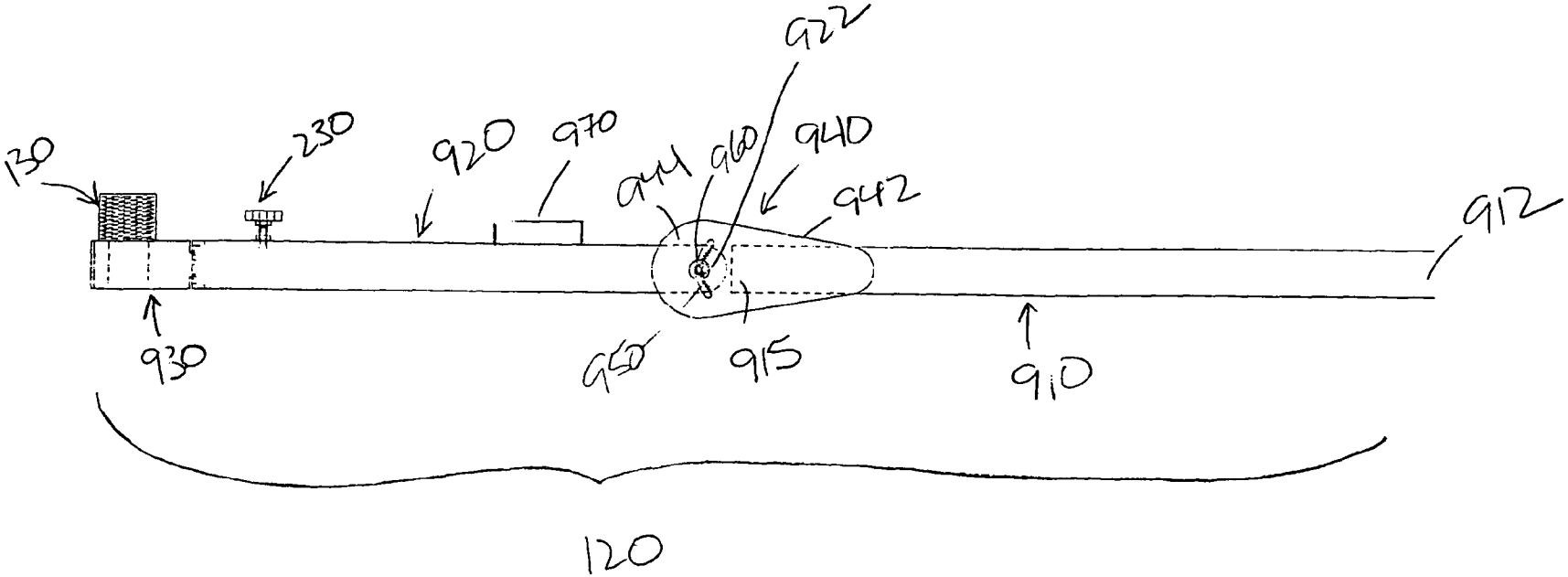
FIG. 9 shows a side view of a portion of the apparatus of FIG. 8.

In the embodiment of Applicant's apparatus shown in FIGS. 8 and 9, horizontal assembly 120 comprises member 910, member 920, and member 930. Member 920 comprises a tubular member. Member 930 is dimensioned to be slidingly insertable within tubular member 920, such that the length of horizontal assembly 120 can be adjusted by increasing or decreasing the portion of member 930 disposed within member 920. The orientation of table 140 and umbrella 160 can be adjusted in the Y/Z plane by rotating member 920 to the desired orientation and then releaseably fixturing member 930 to member 920 using fixturing means 230 in the manner described above.

The orientation of table 140 and umbrella 160 can also be adjusted in the second X/Z plane. Leveling device 970 is disposed on member 920 to visually assist the adjustment of table 140 and umbrella 160 in the X/Z plane. Leveling device 970 comprises an optically clear enclosure which is partially filled with fluid, where the orientation of that fluid within the enclosure visually indicates the gravitational orientation of table 140.

Member 920 is adjustably attached to member 910 using plate 940. Plate 940 comprises proximal portion 942 and distal portion 944. Proximal portion 942 of plate 940 is attached to distal end 915 of member 910. Proximal end 912 of member 910 can be releaseably attached to a trailer hitch as described above. Plate 940 can be attached to end 915 using conventional attachment methods including, for example, welding, integral forming, mechanical attachment using nets and bolts, and the like. Distal portion 944 of plate 940 extends outwardly from end 915 of member 910.

Curved gear lock 950, comprising a plurality of gear teeth, is attached to the exterior surface of distal portion 944 of plate 940. Distal portion 944 of plate 940 is formed to include a threaded aperture extending therethrough adjacent to gear lock 950. End 922 of member 920 is formed to include an aperture therethrough. In certain embodiments, end 922 of member 920 is formed to include a threaded aperture therethrough After adjusting the orientation table 140 and umbrella 160 in the X/Z plane, i.e. adjusting the orientation of member 920 with respect to member 910, threaded bolt 960 is inserted through the aperture formed in end 922 of member 920. In certain embodiments, threaded bolt 960 is threadedly engaged with, and through, the aperture formed in end 922 of member 920.

Threaded bolt 960 extends through the aperture formed in distal portion 944 of plate 940 such that threaded bolt 960 threadedly engages gear lock 950, thereby fixturing member 920 to member 910. In certain embodiments, threaded bolt 960 is threadedly engaged with, and through, the aperture in distal portion 944 of plate 940.

Figure 6:
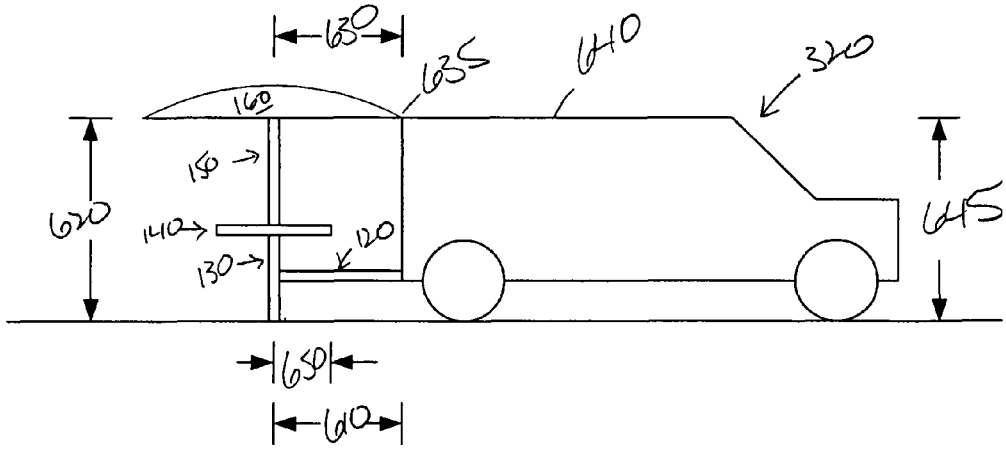
FIG. 6 is a side view showing certain dimensions of Applicant's apparatus with respect to a first attached vehicle.

Referring now to FIG. 6, Applicant's apparatus allows the distance 610 between vehicle 320 and vertical assembly 130 to be adjusted. In the illustrated embodiment of FIG. 6, table 140 comprises a radius 650. By radius of table 140, Applicant means the greatest straight-line distance from shaft 150 to an edge of table 140. Referring again to FIG. 3A, vehicle 320 comprises rear door 322 and rear door 324, each of which has a width 325. Distance 610 can be adjusted such that doors 322 and 324 can be opened and closed while Applicant's apparatus 100 remains interconnected to vehicle 320. More specifically, the length of assembly 120 can be adjusted such that distance 610 minus table radius 650 is greater than rear door width 325.

Applicant's apparatus allows distance 620, i.e. the height of umbrella 160, to be adjusted. In certain embodiments, distances 610 and 620 are adjusted such that distal portion 635 of umbrella portion 160 contacts roof 640 of vehicle 320. Radius 630 of umbrella portion 160 can be dimensioned such that doors 322 and 324 can be opened and closed while umbrella 160 remains attached to vehicle roof 640. In certain embodiments, radius 630 is about 3 feet. In certain embodiments, radius 630 is about 4 feet. In certain embodiments, radius 630 is about 5 feet. In certain embodiments, radius 630 is about 6 feet.

In certain embodiments, distal portion 635 of umbrella 160 is releaseably attached to roof 640. In certain embodiments, such a releasable attachment comprises one or more hook and loop fasteners. In other embodiments, such as releasable attachment comprises one or more two-piece mechanical snap assemblies. In the illustrated embodiment of FIG. 6, the interior of vehicle 320 is protected from inclement weather, such as for example rain, snow, and the like, even if doors 322 and 324 are opened.

Figure 7:
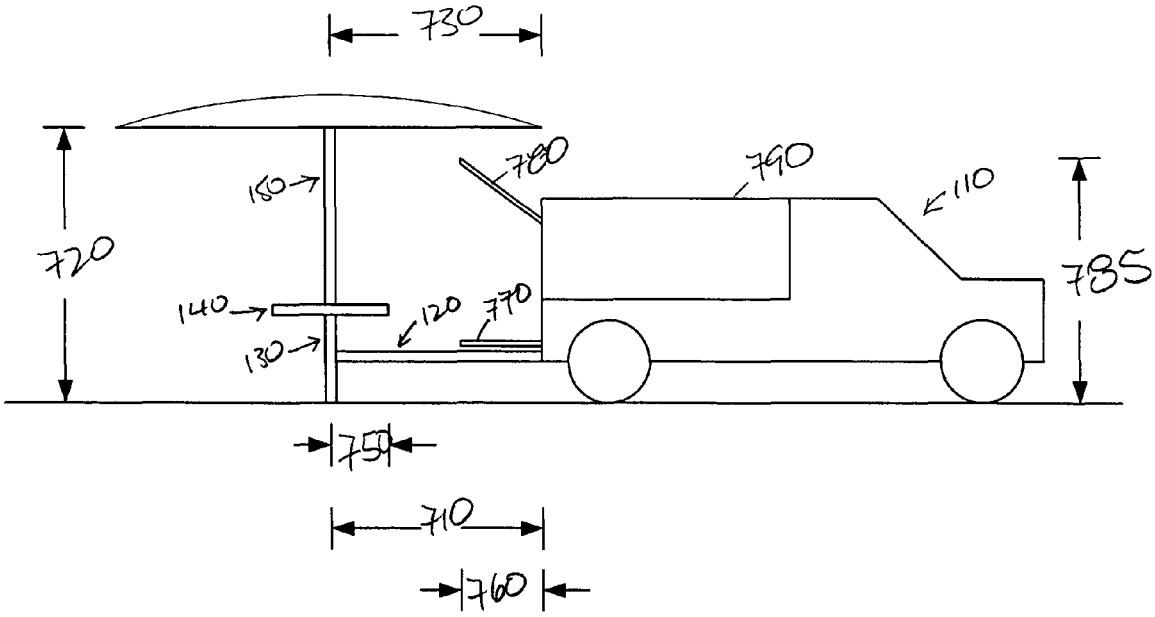
FIG. 7 is a side view showing certain dimensions of Applicant's apparatus with respect to a second attached vehicle.

Referring now to FIG. 7, Applicant's apparatus allows the distance 710 between vehicle 110 and vertical assembly 130 to be adjusted. In the illustrated embodiment of FIG. 7, vehicle 110 comprises tailgate 770 and pivoting hatch-back 780. As those skilled in the art will appreciate, certain vehicles comprise a pivoting hatch-back that extends from the roof to the floor of the vehicle. References herein to "pivoting hatch-back" include the embodiment illustrated in FIG. 7 and also to embodiments wherein the pivoting hatch-back extends from the roof to the floor.

When opened, tailgate 770 extends a horizontal distance 760 backwardly from vehicle 110. When opened, hatch-back 780 extends a horizontal distance 760 backwardly from vehicle 110, and extends a vertical distance 785 above the ground. The length of assembly 120 can be adjusted such tailgate 770 and/or hatch-back 780 can be opened and closed while Applicant's apparatus 100 remains interconnected to vehicle 110. More specifically, the length of assembly 120 can be adjusted such that distance 710 minus table radius 750 is greater than distance 760.

Applicant's apparatus allows distance 720, i.e. the height of umbrella 160, to be adjusted. In certain embodiments, distances 710 and 720 are adjusted such that distance 710 minus table radius 750 is greater than distance 760, and such that distance 720 is greater than distance 785. In the illustrated embodiment of FIG. 7, distance 720 is adjusted such that distal end 735 of umbrella 160 is positioned over a portion of roof 790.

Radius 730 of umbrella portion 160 can be dimensioned such that tailgate 770 and/or hatch-back 780 can be opened and closed while Applicant's apparatus 100 remains interconnected to vehicle 110. In certain embodiments, radius 730 is about 3 feet. In certain embodiments, radius 730 is about 4 feet. In certain embodiments, radius 730 is about 5 feet. In certain embodiments, radius 730 is about 6 feet.

In the illustrated embodiment of FIG. 7, distance 710 minus table radius 750 is greater than distance 760, distance 720 is greater than distance 785, and radius 730 is greater than distance 710. In the illustrated embodiment of FIG. 7, the interior of vehicle 110 is protected from inclement weather, such as for example rain, snow, and the like, even if tailgate 770 and/or hatch-back 780 are opened.

While the preferred embodiments of the present invention have been illustrated in detail, it should be apparent that modifications and adaptations to those embodiments may occur to one skilled in the art without departing from the scope of the present invention as set forth in the following claims.

I claim:

1. An adjustable portable table assembly, comprising:

a horizontal assembly comprising a first end and a second end;

a tubular vertical assembly having a diameter, wherein said tubular vertical assembly comprises a first open end and a second open end, wherein said second end of said horizontal assembly is attached to said vertical assembly adjacent said first open end;

a table comprising a top surface and formed to include an aperture having said diameter, wherein said table is attached to said vertical assembly at said second open end such that said aperture is aligned with said second open end;

wherein said horizontal assembly comprises:

a first tubular member;

a second member, wherein part of said second member is slidingly and rotatably disposed within said first tubular member, and wherein a distal end of said second member comprises said second end of said horizontal assembly;

a first fixturing means capable of releaseably attaching said second member to said first tubular member;

wherein an overall length of said horizontal assembly can be adjusted by increasing or decreasing a length of said second member inserted into said first tubular member; and wherein:

rotating said second member within said first tubular member also causes rotation of said vertical assembly with respect to said horizontal assembly;

said top surface of said table can be placed in a gravitationally level orientation by rotating said second member within said first tubular member until objects placed on said top surface of said table will not slide or roll off said table.

2. The portable table of claim 1, wherein said vehicle comprises a trailer hitch receiving assembly comprising an enclosure comprising opposing walls and an open end, and formed to include a pair of opposing apertures in said opposing walls, and wherein said horizontal assembly is formed to include a horizontal assembly aperture adjacent said first end, further comprising:

a nut disposed within said first end of said horizontal assembly, wherein said nut is formed to include a threaded aperture, wherein said first end of said horizontal assembly can be inserted into said trailer hitch receiving assembly such that said horizontal assembly aperture is aligned with said threaded aperture;

a securing means comprising a handle, a shaft attached to said handle and extending outwardly therefore, wherein the distal end of said shaft is threaded such that said distal end can be threadedly engaged with said threaded aperture.

3. The adjustable portable table of claim 1, wherein said vertical assembly is dimensioned such that said table comprises a height above the ground of about 30 inches.

4. The adjustable portable table of claim 1, wherein said vertical assembly is dimensioned such that said table comprises a height above the ground of about 36 inches.

5. The adjustable portable table of claim 1, wherein said vertical assembly is dimensioned such that said table comprises a height above the ground of between about 42 inches and about 48 inches.

6. The apparatus of claim 1, wherein said first tubular member is formed to include a first threaded aperture extending therethrough, and wherein said first fixturing means comprises:

a first handle;

a first threaded shaft attached to said first handle, wherein said first threaded shaft can be threadedly engaged with said first threaded aperture.

7. The apparatus of claim 1, wherein said vehicle comprises a vehicular electrical system, further comprising:

a plurality of batteries disposed within said first tubular member;

a battery charging unit electrically interconnected with said plurality of batteries and electrically interconnected with said vehicular electrical system, wherein said charging unit is disposed within said first tubular member;

a first output power receptacle electrically connected with said plurality of batteries, wherein said first output power receptacle is disposed on the exterior of said first tubular member.

8. The apparatus of claim 7, further comprising:

an inverter electrically connected to said plurality of batteries;

a second output power receptacle electrically connected with said inverter, wherein said second output power receptacle is disposed on the exterior of said first tubular member.

9. The apparatus of claim 1, wherein said horizontal member further comprises:

a third member having a first end and a second end, wherein said first end of said third member, rather than said first end of said first tubular member, can be releaseably attached to said vehicle;

a plate comprising a proximal portion and a distal portion, wherein said proximal portion is attached to said second end of said third member, and wherein said distal portion extends outwardly from said second end of said third member, wherein said plate is formed to include an aperture extending through said distal portion, said plate further comprising a plurality of gear teeth disposed adjacent said aperture, wherein each of said plurality of gear teeth is equidistant from said aperture;

a threaded bolt;

wherein said first end of said first tubular member is formed to include an aperture, and wherein said threaded bolt extends through said aperture formed in said first end of said first tubular member, and wherein said threaded bolt extends through said aperture formed in said distal portion of said plate, and wherein said threaded bolt threadedly engages one or more of said plurality of gear teeth;

wherein the orientation of said table can be adjusted in a second plane, wherein said second plane is orthogonal to said first plane.

10. The apparatus of claim 1, wherein said table further comprises a center point, and wherein said table is formed to include an aperture extending through said center point, said apparatus further comprising:

a shelter assembly comprising an umbrella and an umbrella shaft, wherein said umbrella shaft comprises a first end and a second end, wherein said first end of said umbrella shaft is attached to said umbrella, and wherein said umbrella shaft extends through said aperture and through said vertical assembly;

wherein the position of said umbrella shaft within said vertical assembly can be adjusted upwardly and downwardly.

11. The apparatus of claim 10, wherein said vertical assembly further comprises:

a second tubular member comprising a first end and a second end, wherein said first end of said second tubular member is attached to said second end of said second member, and wherein said second end of said second tubular member is attached to said table such that said umbrella shaft extends through said aperture and through said second tubular member;

a second fixturing means capable of releaseably attaching said umbrella shaft to said second tubular member.

12. The apparatus of claim 11, wherein said second tubular member is formed to include a second threaded aperture extending therethrough, and wherein said second fixturing means comprises:

a second handle;

a second threaded shaft attached to said second handle, wherein said second threaded shaft can be threadedly engaged with said second threaded aperture.

13. The apparatus of claim 10, further comprising a lifting mechanism, wherein said second end of said umbrella shaft is disposed on top of said lifting mechanism.

14. The apparatus of claim 13, wherein said vehicle comprises a source of electric power, and wherein said lifting mechanism further comprises a motor and a moveable shaft, wherein said second end of said umbrella shaft is disposed on top of said moveable shaft, said apparatus further comprising:

a switch;

a first power cable interconnecting said switch and said vehicular source of power;

a second power cable interconnecting said switch and said motor.

15. The apparatus of claim 14, further comprising a plurality of lights disposed on said shelter assembly, wherein each of said plurality of lights is interconnected to said first power cable.

16. The apparatus of claim 14, further comprising an electrical receptacle interconnected to said first power cable.

17. The apparatus of claim 1, further comprising:

a vehicle releaseably attached to said first end of said horizontal assembly;

wherein said table has a table radius, and wherein said vehicle comprises a rear door having a width, wherein said overall length is adjusted such that said overall length minus said table radius is greater than said width.

18. The apparatus of claim 1, further comprising a vehicle, wherein said table has a table radius, and wherein said vehicle comprises a pivotable hatch-back which when open extends a distance backwardly from said vehicle, wherein said overall length minus said table radius is greater than said distance.

* * * * *